US005853968A

United States Patent [19]

English et al.

[11] Patent Number: 5,853,968

[45] Date of Patent: Dec. 29, 1998

[54] MULTILAYER COLOR PHOTOGRAPHIC ELEMENT

[75] Inventors: Daniel R. English, Pittsford; Steven G. Link; Hans G. Ling, both of Rochester, all of N.Y.

[73] Assignee: Eastman Kodak Company, Rochester, N.Y.

[21] Appl. No.: 753,648

[22] Filed: Nov. 27, 1996

[51] Int. Cl.[6] ..... G03C 1/46

[52] U.S. Cl. ..... 430/506; 430/570; 430/572; 430/574; 430/576; 430/577; 430/581; 430/585

[58] Field of Search ..... 430/570, 572, 430/574, 576, 577, 581, 585, 506

[56] References Cited

U.S. PATENT DOCUMENTS

| | | | |
|---|---|---|---|
| 3,667,958 | 6/1972 | Evans | 96/114.1 |
| 3,922,170 | 11/1975 | Shiba et al. | 430/574 |
| 3,977,882 | 8/1976 | Shiba et al. | 430/574 |
| 4,039,335 | 8/1977 | Hinata et al. | 430/574 |
| 4,135,933 | 1/1979 | Hinata et al. | 430/574 |
| 4,147,553 | 4/1979 | Sato et al. | 430/574 |
| 4,307,185 | 12/1981 | Hinata et al. | 430/574 |
| 4,308,345 | 12/1981 | Hinata et al. | 430/574 |
| 4,326,023 | 4/1982 | DeSeyn | 430/574 |
| 5,464,735 | 11/1995 | Preddy et al. | 430/574 |

*Primary Examiner*—Geraldine Letscher
*Attorney, Agent, or Firm*—Arthur E. Kluegel

[57] ABSTRACT

The invention provides a color negative photographic element comprising a transparent support bearing at least two light sensitive silver halide emulsion layers sensitive to blue light, at least two such layers sensitive to green light, and at least two such layers sensitive to red light, wherein at least one of the red sensitive emulsion layers is spectrally sensitized with both a particular first carbocyanine dye (I) which contains both a thiazole and an oxazole ring and a particular second carbocyanine dye (II) which contains two thiazole rings.

The element of the invention is advantageous in allowing an increased efficiency of silver removal during the bleaching step of the development process.

28 Claims, No Drawings

MULTILAYER COLOR PHOTOGRAPHIC ELEMENT

FIELD OF THE INVENTION

This invention comprises a multilayer color photographic element having at least two silver halide emulsion layers sensitive to red light, at least two such layers sensitive to green light, and at least two such layers sensitive to blue light wherein the silver halide grains of a red sensitive layer contain on the surface thereof a particular combination of dyes.

BACKGROUND OF THE INVENTION

One critical need for spectral sensitization of color negative and color reversal films is to have a high degree of accurate color reproduction. To do this the film must be sensitized as closely as is possible to the sensitivity of the human eye. Particularly in the red region of the spectrum, current films are mismatched from the human eye, with peak red sensitivity of the film occurring at wavelengths greater than about 640 nm, while the eye has a peak red sensitivity around 610 nm. In order to improve the color reproduction of color films it is therefore necessary to find suitable short red sensitizing dyes.

It is common in the art of spectral sensitization of silver halide emulsions to use cyanine dyes that transfer the energy of adsorbed light to the conduction band of the silver halide, thus making the silver halide sensitive to wavelengths longer than its native sensitivity. Furthermore, in the spectral sensitization of silver halide emulsions for color photographic applications, it is customary to use J-aggregating cyanine dyes because of the narrower absorption of the aggregate and the improved color separation that it provides. Along with the ability to adsorb to silver halide and the ability to transfer the energy of absorbed light to the silver halide, cyanine dyes must also have adequate solubility and not interfere with any of the processing steps whereby the latent silver image is converted to a visible dye image. One unfavorable interaction is that cyanine dyes also adsorb to developed silver deposits and cause a decrease in the desilvering rate of color negative materials during the silver bleaching step [*Nippon Shashin Gakkaishi* (*Journal of Japanese Photographic Association*), *Vol.* 39 (2), p. 81 (1976).] This problem manifests itself in complex multilayer elements (defined herein to mean containing two or more layers sensitive to each of red, green, and blue light). Such elements encompass image capture films where low light/high speed are necessary. This category includes color negative films destined for use in forming image positives through optical printing as well as reversal films. Color print elements contain a single layer sensitive to each color and much lower silver levels and thus do not present a bleaching problem. This bleaching problem is particularly troublesome with processing solutions that are aged, such that some of the bleaching power has been exhausted. In the trade this is known as seasoning of the solution. In order to solve this problem, it has been suggested to incorporate bleach accelerator releasing couplers or other compounds (BARCS) in the film that release bleaching accelerators during the development step. These chemicals are very expensive and add additional chemical costs to the manufacture of the film. In addition, increased use of BARCS in either the green or red record of a multilayer color photographic element tend to reduce the ability of that record to be impacted by interlayer image modification and hence reduce the color accuracy and color saturation of the color photographic film. The usage of BARCS is therefore to be minimized.

U.S. Pat. No. 3,922,170 suggests the use of a carbocyanine dye combination which encompasses the dye combination of the invention. However, the combination is never employed in a complex multilayer color element nor is there any suggestion of the beneficial effect on silver removal in such a complex element.

It is a problem to be solved to provide a complex multilayer color photographic element which exhibits improved bleaching when a seasoned bleach bath is used during processing.

SUMMARY OF THE INVENTION

The invention provides a color negative photographic element comprising a transparent support bearing at least two light sensitive silver halide emulsion layers sensitive to blue light, at least two such layers sensitive to green light, and at least two such layers sensitive to red light, wherein at least one of the red sensitive emulsion layers is spectrally sensitized with both of the following dyes:

(A) a sensitizing dye of the formula (I):

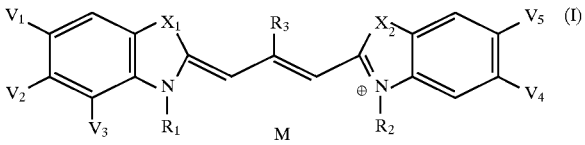

wherein:

either $V_1$ and $V_2$ or $V_2$ and $V_3$ are joined to form a fused ring and the remaining member of $V_1$, $V_2$, and $V_3$ is hydrogen;

$V_4$ and $V_5$ are independently selected from the group consisting of hydrogen, methyl, ethyl, methoxy, ethoxy, halogen, phenyl groups, heteroaromatic 5- or 6-membered ring groups, cyano, and acetamido;

$R_1$ and $R_2$ are independently 2 to 6 carbon alkyl groups at least one of which is substituted by a carboxyl or sulfonic acid anion;

$R_3$ is an alkyl group of 1 to 4 carbon atoms;

$X_1$ and $X_2$ are either oxygen or sulfur but are not the same; and

M is a counter ion to balance the charge on (I);

and (B) a sensitizing dye of the formula (II):

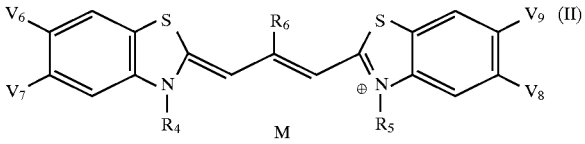

wherein $V_6$, $V_7$, $V_8$ and $V_9$ are independently any of the groups as described for $V_4$ in formula (I);

$R_4$ and $R_5$ are independently any of the groups described for $R_1$ in formula (I);

$R_6$ may be any of the groups as described for $R_3$ in formula (I); and

M is a counter ion to balance the charge of (II).

The invention also provides a method of forming an image in the element of the invention.

The invention advantageously provides a complex multilayer color photographic element which exhibits improved bleaching when a seasoned bleach bath is used during processing.

DETAILED DESCRIPTION OF THE INVENTION

The invention is generally described in the Summary of the Invention. Formula (I) is as follows:

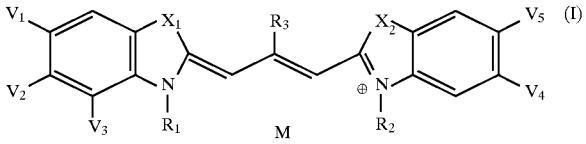

In the formula, either $V_1$ and $V_2$ or $V_2$ and $V_3$ are joined to form a fused ring and the remaining member of $V_1$, $V_2$, and $V_3$ is hydrogen. Typically, the ring is a benzene ring and is suitably formed by $V_2$ and $V_3$.

$V_4$ and $V_5$ are independently selected from the group consisting of hydrogen, methyl, ethyl, methoxy, ethoxy, halogen, phenyl groups, heteroaromatic 5- or 6-membered ring groups, cyano, and acetamido groups. Examples include methyl, methoxy, pyrrolyl, furyl, chloro, bromo, fluoro, phenyl such as p-chlorophenyl groups. Preferably they are independently selected methyl or methoxy.

$R_1$ and $R_2$ are independently selected 2 to 6 carbon alkyl groups at least one of which is substituted by a carboxyl or sulfonic acid anion. Examples are 3-sulfopropyl, 2-sulfopropyl, 2-carboxyethyl and other sulfo and carboxy derivatives of the lower alkyl groups such as methyl, ethyl, and propyl.

$R_3$ is an alkyl group of 1 to 4 carbon atoms. Examples are methyl, ethyl, and propyl.

$X_1$ and $X_2$ are either oxygen or sulfur but are not the same.

M is a counter ion to balance the charge on (I). Alkali metals and cationic amines (e.g. sodium, potassium, triethylammonium, tetramethylguanidinium) are suitably used as charge balancing cations and chloride, bromide, iodide, fluoborate, p-toluenesulfonate are suitably used as charge balancing anions.

A preferred formula for dye (I) is:

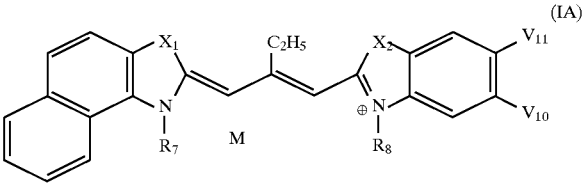

in which $V_{10}$, and $V_{11}$ are selected from the group consisting of methyl, methoxy, hydrogen, and halogen and $R_7$, and $R_8$ are sulfoalkyl groups containing 2-6 carbon atoms.

Formula (II) is as follows

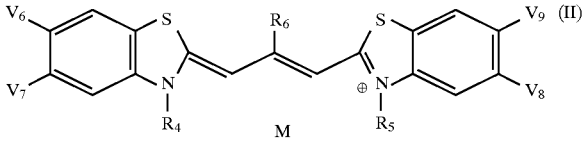

$V_6$, $V_7$, $V_8$ and $V_9$ are independently any of the groups as described for $V_4$ in formula (I). Suitably they are independently hydrogen, methyl, ethyl, methoxy, ethoxy, halogen, phenyl groups, heteroaromatic 5- or 6-membered ring groups, cyano, and acetamido. Examples include methyl, methoxy, chloro, bromo, fluoro, phenyl, furyl, pyrrolyl and acetamido. Preferably they are independently selected methyl, methoxy, or halogen.

$R_4$ and $R_5$ are independently any of the groups described for $R_1$ in formula (I); $R_6$ may be any of the groups as described for $R_3$ in formula (I); and M is a counter ion to balance the charge of (II).

A preferred dye of Formula (II) has formula (IIA).

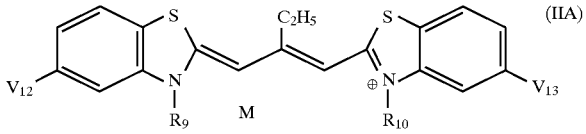

$V_{12}$, and $V_{13}$ are selected from the group consisting of methyl, methoxy, hydrogen, and halogen, and $R_9$, and $R_{10}$ are sulfoalkyl groups containing 2–6 carbon atoms.

The amount of the dye of Formula (I) relative to the amount of dye of Formula (II) should be sufficient to provide a wavelength of maximum absorbance of less than 640 nm. Normally the maximum will be in the range of 600 to 640 nm and more usefully in the range of 610 to 635 nm. Typically the relative amounts of the dyes will be in mole ratio of I:II in the range of 0.1 to 10:1. Desirably the range will be in the range of 0.5 to 9:1 and conveniently in the range of 2 to 9:1. Desirably the sensitivity at 650 nm is not more than 35% of the maximum and more desirably not more than 25%. The sensitivity of the film can be measured, for example, by exposing it though a stepped wedge with a monochromatic light source at 10 nm intervals and determining the exposure necessary to produce a density of 0.2 above the minimum density.

Examples of dyes of formula (I) and (II), including counter ion, are as follows

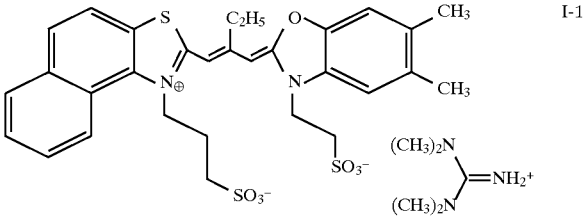

I-1

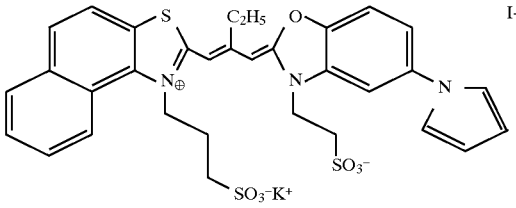

I-2

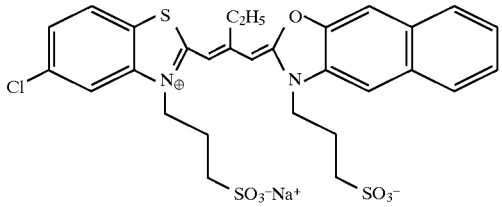

I-3

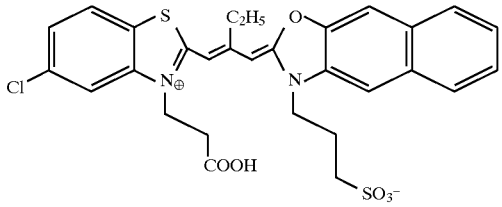

I-4

-continued
I-5
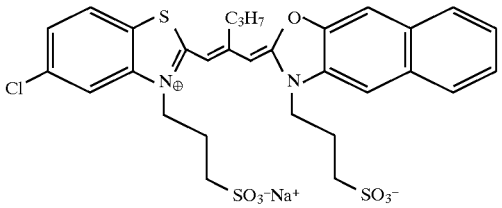
I-6
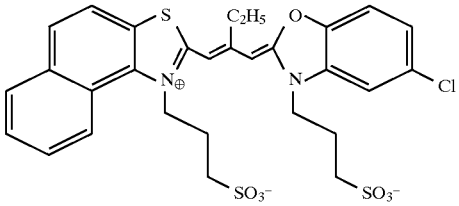
$(CH_3CH_2)_3NH^+$
I-7
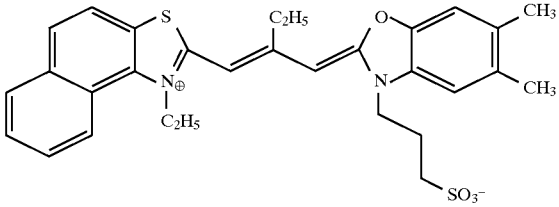
I-8
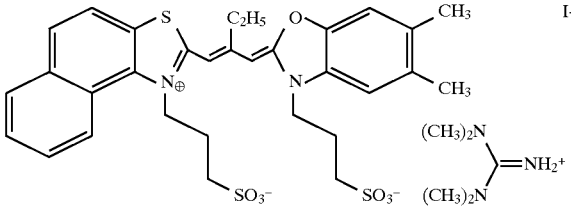
I-9
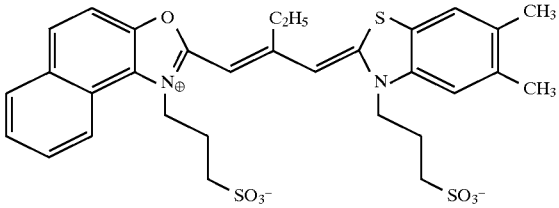
$(CH_3CH_2)_3NH^+$
I-10
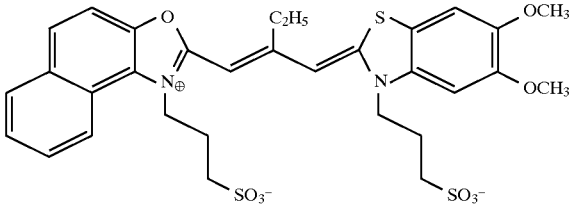
$(CH_3CH_2)_3NH^+$
-continued
I-11
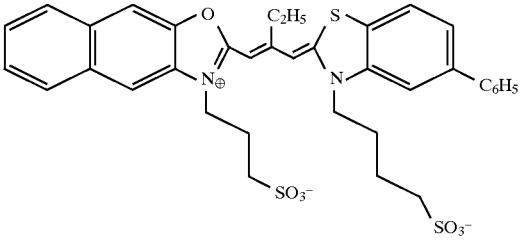
$(CH_3CH_2)_3NH^+$
I-12
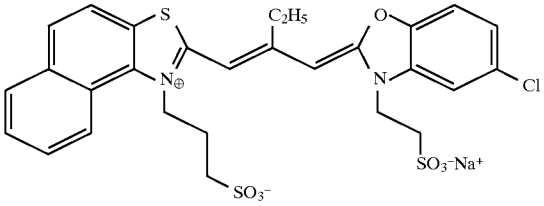
$(CH_3CH_2)_3NH^+$
II-1
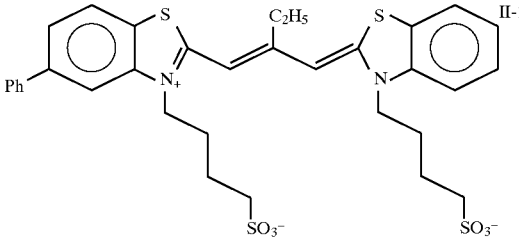
$(CH_3CH_2)_3NH^+$
II-2
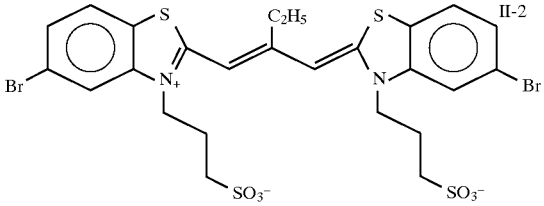
$(CH_3CH_2)_3NH^+$
II-3
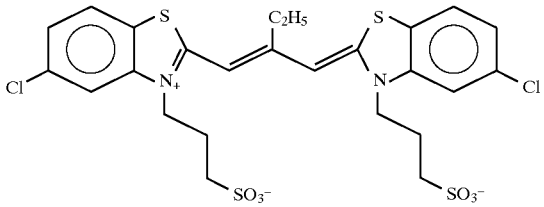
$(CH_3CH_2)_3NH^+$
II-4
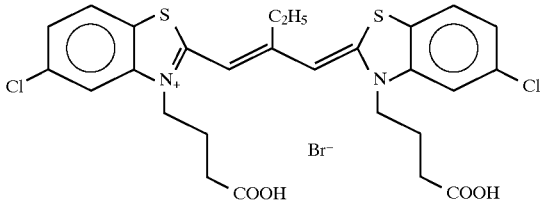

-continued

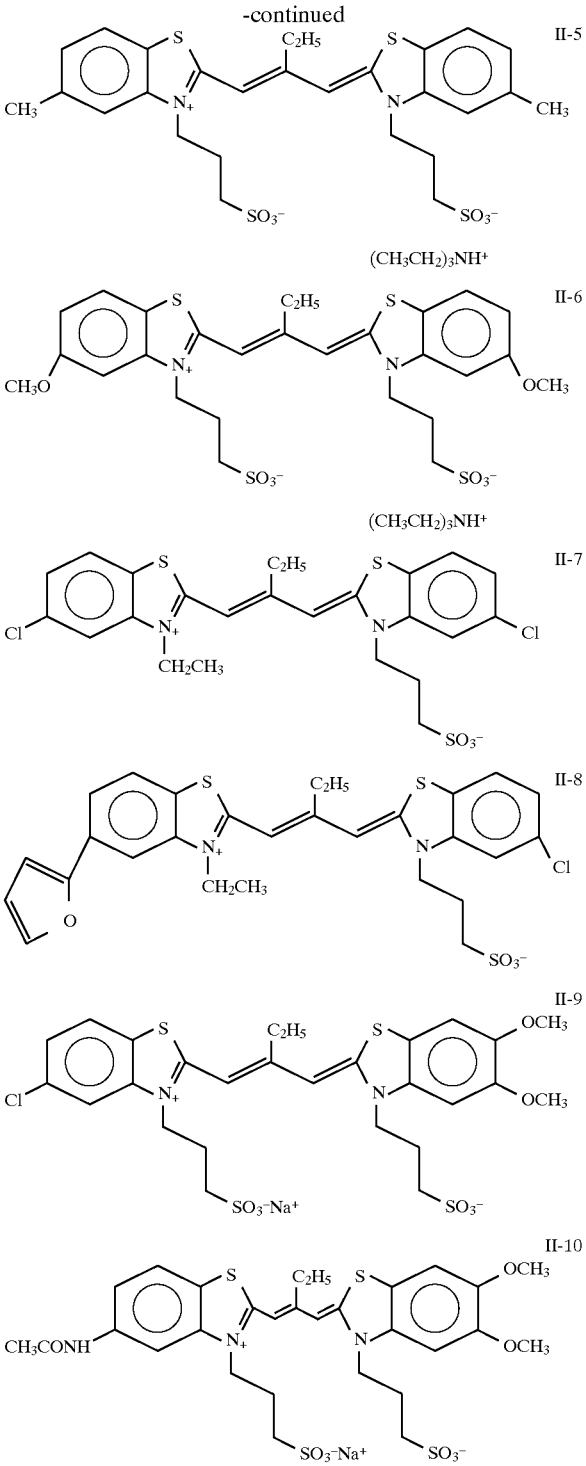

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl; alkenyl, such as ethylene and 2-butene; alkoxy, such as methoxy, ethoxy, propoxy, butoxy, 2-methoxyethoxy, sec-butoxy, hexyloxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, N-succinimido, N-phthalimido, 2,5-dioxo-1-oxazolidinyl, ethoxycarbonylamino, phenoxycarbonylamino, benzyloxycarbonylamino, phenylcarbonylamino, N-methylureido, N,N-dimethylureido, N-phenylureido, and t-butylcarbonamido; sulfonamido, such as methylsulfonamido, benzenesulfonamido, and p-toluylsulfonamido, sulfamoyl, such as N-methylsulfamoyl, N-ethylsulfamoyl, N,N-dipropylsulfamoyl, N,N-dimethylsulfamoyl; carbamoyl, such as N-methylcarbamoyl, N,N-dibutylcarbamoyl; acyl, such as phenoxycarbonyl, butoxycarbonyl, ethoxycarbonyl, benzyloxycarbonyl; sulfonyl, such as methylsulfonyl, phenylsulfinyl; and p-toluylsulfinyl; thio, such as ethylthio, phenylthio, and p-tolylthio; acyloxy, such as acetyloxy, benzoyloxy, N-phenylcarbamoyloxy, N-ethylcarbamoyloxy; amine, such as phenylanilino, 2-chloroanilino, diethylamino; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furiyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The amount of sensitizing dye that is typically used is in the range of 0 to 2.0 mmoles per mole of silver halide and more typically 0.2 to 1.3 mmoles per mole of silver halide. Synthesis of sensitizing dyes may be accomplished by known methods such as those described in Hamer, *Cyanine Dyes and Related Compounds* (1964), and James, *The Theory of the Photographic Process* 4th Ed (1977).

The silver halide grains may be sensitized by any method known in the art. See Research Disclosure cited herein for example. The dye may be added to an emulsion at any time prior to or simultaneously with the coating of the emulsion on a photographic element. The silver halide grains may be chemically sensitized and the emulsion may include any of the addenda, dispersions and other adjuvants known in the art. Addition of the dye(s) may occur before or after chemical sensitization, using an aqueous or organic solvent medium or as a gel or solid particle dispersion, and may be used in combination with other sensitizing dyes.

The silver halide grains useful herein may be the tabular, octahedral or cubic type and may be comprised of silver halides including chloride, bromide and iodide. Typically, they will comprise a major portion of silver bromide and a minor portion of silver iodide (e.g. less than 10 mol% or 2–6 mol% AgI).

The materials of the invention can be used in any of the ways and in any of the combinations known in the art. Typically, the invention materials are incorporated in a silver halide emulsion and the emulsion coated as a layer on a support to form part of a photographic element.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The multicolor elements contain image dye-forming units sensitive to each of the three primary regions of the spectrum. Each unit comprises two or more emulsion layers sensitive to a given region of the spectrum. The layers of the element, including the layers of the image-forming units, can be ananged in various orders as known in the art.

A typical multicolor photographic element comprises a support bearing a cyan dye image-forming unit closest to the support comprised of at least two red-sensitive silver halide emulsion layers having associated therewith at least one cyan dye-forming coupler, a magenta dye image-forming unit comprising at least two green-sensitive silver halide emulsion layers having associated therewith at least one magenta dye-forming coupler, and, located furthest form the support, a yellow dye image-forming unit comprising at least two blue-sensitive silver halide emulsion layers having associated therewith at least one yellow dye-forming coupler. The element can and usually does contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

The silver halide emulsion containing elements employed in this invention are negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that fonn magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos.4,859,578; 4,912,025), antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4.956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

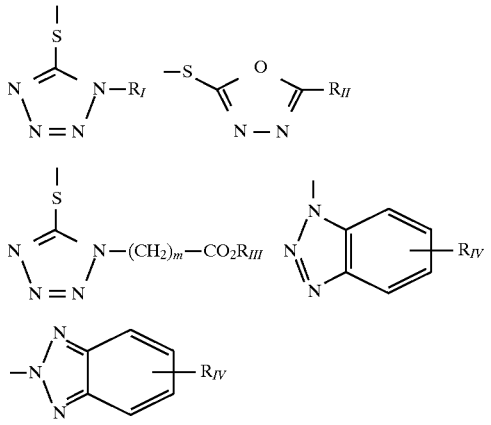

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and -$SR_I$; $R_{III}$ is a straight or branched alkyl group of from $_1$ to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aiyl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

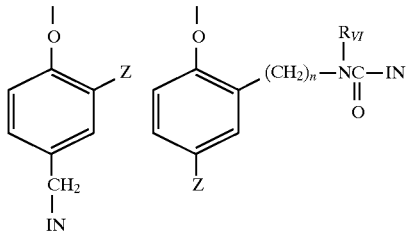

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

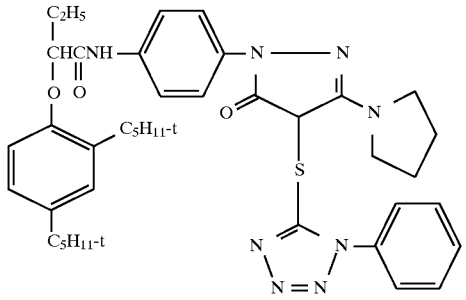

-continued

D2

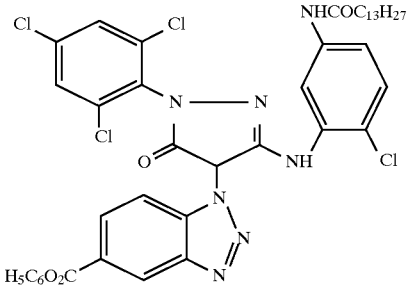

D3

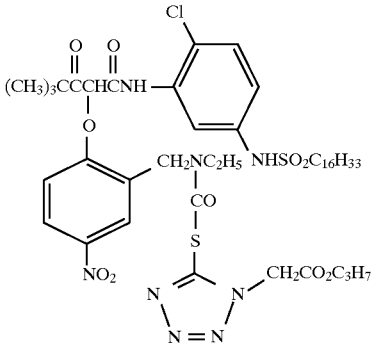

D4

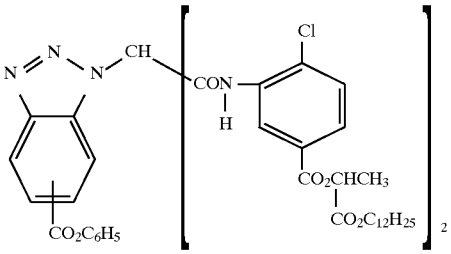

D5

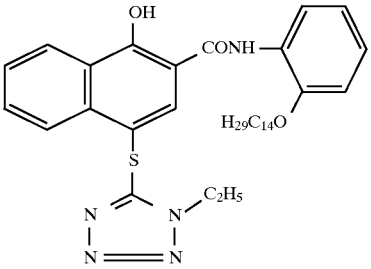

D6

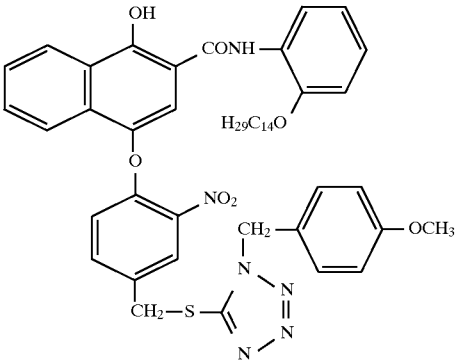

-continued

D7

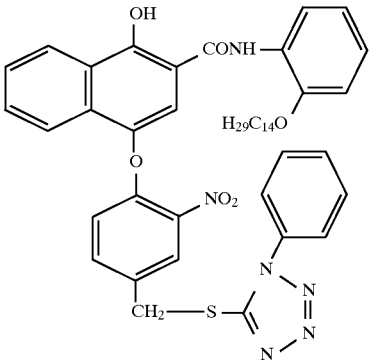

D8

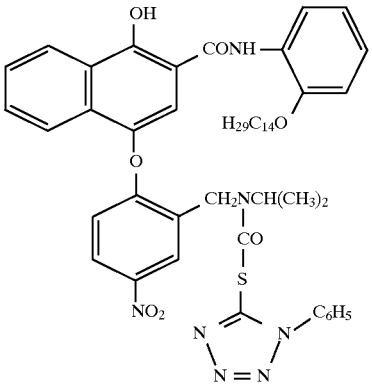

D9

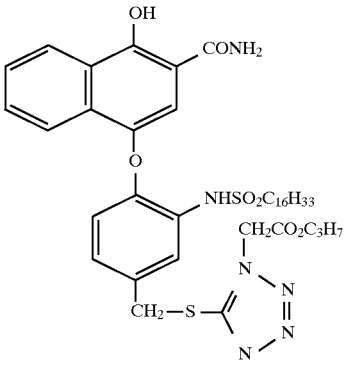

D-10

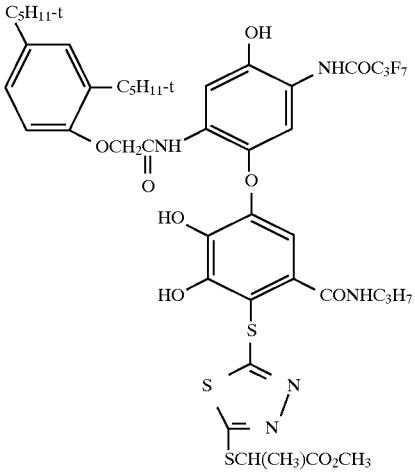

-continued

D11

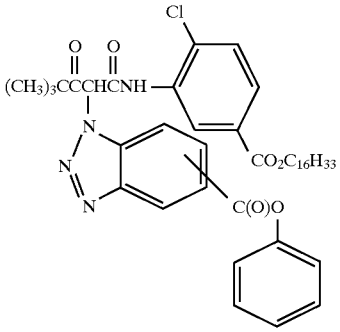

D12

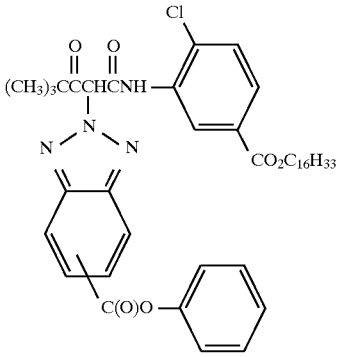

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the teim "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabulanity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.07$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following:

Research Disclosure, Item 22534, January 1983, published by Kenneth Mason Publications, Ltd., Emsworth, Hampshire PO10 7DD, England; U.S. Pat. Nos. 4,439,520, 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element is designed for image capture, and speed (the sensitivity of the element to low light conditions) is usually critical to obtaining sufficient image in such elements. When such elements are to be subsequently used to optically generate a color print, they are provided on a transparent support. They may then be processed, for example, in known color negative processes such as the Kodak C-41 process as described in The British Journal of Photography Annual of 1988, pages 191–198. If such an element is to be employed to generate a viewable projection print as for a motion picture, a process such as the Kodak ECN-2 process described in the H-24 Manual available from Eastman Kodak Co. may be employed to provide the print on a transparent support. Color negative development times are typically 3' 15" or less and desirably 90 or even 60 seconds or less.

Elements destined for color reflection prints are provided on a reflective support and may be exposed via optical negative/positive printing and processed, for example, using the Kodak RA-4 process as described in The British Journal of Photography Annual of 1988, pp 198–199; color projection prints may be processed, for example, in accordance with the Kodak ECP-2 process as described in the H-24 Manual. Color print development times are typically 90 seconds or less and desirably 45 or even 30 seconds or less.

To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

EXAMPLES

COMPARATIVE EXAMPLE

This example shows that the dye combination of the invention does not exhibit any advantage for silver bleaching outside of the multilayer environment of the photographic element of the invention.

A tabular iodobromide emulsion (4.5% iodide, 1.11$\mu$ ECD by 0.107$\mu$) which contained 40 g of gelatin per silver mole, was chemically and spectrally sensitized as follows:

At 40° C., 100 mg sodium thiocyanate per mole of silver was added and held 5 minutes.

35 mg of 3-methylsulfonylcarbamoylethylbenzothiazolium fluoborate per mole of silver was added and held for 2 minutes.

A total of 1.035 mmole per mole of silver of two sensitizing dyes were added from a common solution in methanol and held for 20 minutes. The dyes and the amounts are given in Table Comp-1.

3.2 mg of aurous dithiosulfate per mole of silver and 1.6 mg of sodium thiosulfate pentahydrate per mole of silver were then added.

The emulsion was heated to 65° C. at a rate of 1.67 degrees per minute, held at 65° C. for 5 minutes, then cooled to 40° C. at a rate of 1.67 degrees per minute.

The emulsions were then diluted to the appropriate concentration with distilled water and gelatin and coated onto a 5 mil cellulose triacetate support subbed with 0.323 g gelatin/$m^2$.

First layer: Emulsion (3.23 g Ag/$m^2$), gelatin (3.23 g/$m^2$), Cyan coupler 1 as in Example 1 [Hexanamide, 2-(2,4-bis (1,1-dimethylpropyl) phenoxy)-N-(4-((((4-cyanophenyl) amino)carbonyl)amino)-3-hydroxyphenyl)-] (2.15 g/m2), tricresyl phosphate (2.15 g/m2), surfactants as coating aids.

Overcoat: Gelatin (1.08 g/m2), surfactants as coating aids, bis-vinylsulfonylmethane (1.75% by weight of the total gelatin).

Film strips of these samples were given a Dmax exposure, then submitted to standard Kodak C-41 color development but omitting the bleach step. The amount of developed silver was measured by measuring the IR density of the film after processing. The processing of the samples was repeated, except that a ferric EDTA bleach step was added, and the bleach solution was deliberately contaminated with 10% by volume of developer solution. This is to simulate seasoning of the developer as might occur during actual trade processing. The bleaching time was varied for 2, 3, or 4 minutes. The percentage of retained silver (by IR density) after fixing and washing vs. bleaching time is shown in the table. The retained silver is reported as the percentage of IR density remaining compared to the density for the develop/fix/wash process.

TABLE COMP-1

| Sample | dye 1 | dye 2 | IR 2' bleach | density 3' bleach | left 4' bleach |
|---|---|---|---|---|---|
| 1 | I-1 0.518 | II-3 0.518 | 8.0% | 6.9% | 6.6% |
| 2 | I-1 0.690 | II-3 0.345 | 7.9% | 7.0% | 6.2% |
| 3 | I-1 0.863 | II-3 0.173 | 7.2% | 6.0% | 5.7% |
| 4 | I-11 0.518 | II-3 0.518 | 6.3% | 5.5% | 5.5% |
| 5 | I-10 0.690 | II-3 0.345 | 7.0% | 5.9% | — |
| 6 | I-12 0.690 | II-3 0.345 | 6.2% | 6.0% | 5.3% |
| 7 | A 0.690 | II-3 0.345 | 5.7% | 5.5% | 5.2% |
| 8 | B 0.690 | II-3 0.345 | 5.3% | 4.5% | 4.9% |
| 9 | I-7 0.690 | II-3 0.345 | 5.5% | 5.3% | 4.8% |
| 10 | CSD-2 (= II-5) 0.104 | II-3 0.932 | 7.6% | 6.5% | 6.0% |

Dye amounts are in mmoles per mole silver.

The data show that the preferred dye combinations in samples 1, 2, and 3 did not provide any bleaching advantage in the absence of a multilayer photographic element containing 2 or more red sensitive layers.

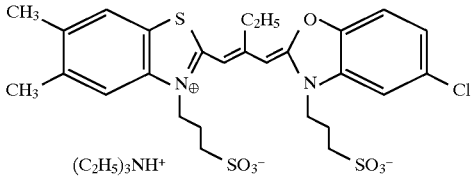

Dye A

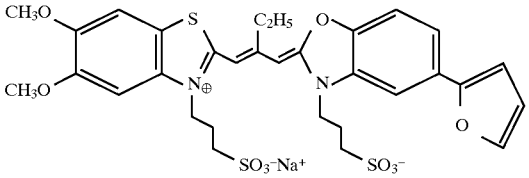

Dye B

Example 1a

Multilayer color negative film Sample 1-1 (Comparison) was prepared as described hereinafter. The red sensitive emulsions were spectrally sensitized with a 6:1 molar ratio of dyes II-3 and CSD- 1. Samples 1-2 (Comparison) and 1-3 (Inventive) were prepared with identical blue and green sensitive records, but sample 1-2 used a 9:1 molar ratio of dyes II-3 and CSD-2(II-5), while sample 1-3 used a 1:2 molar ratio of II-3 and I-1. Sample 1-1 had a red spectral sensitivity maximum at 650 nm, sample 1-2 at 660 nm, and sample 1-3 at 630 nm. Thus, sample 1-3 has improved color reproduction and improved illuminantinsensitivity relative to samples 1-1 and 1-2 because it is closer to the eye sensitivity at 610 nm.

The multilayer color negative film Sample 1-1 was prepared by coating on a triacetyl cellulose film support the following layers in order from the support side (amounts given are in grams per $m^2$ with emulsions expressed as grams of silver per $m^2$).

| | |
|---|---|
| Layer 1: Antihalation Layer | |
| Black colloidal silver | 0.151 |
| Gelatin | 2.443 |
| Cyan dye 1 | .020 |
| Cyan dye 2 | .008 |
| Magenta dye 1 | .042 |
| Yellow dye 1 | .008 |
| Yellow dye 2 | .018 |
| Yellow dye 4 | .088 |
| UV dye 1 | .075 |
| UV dye 2 | .075 |
| Antioxidant 1 | .161 |
| Antifoggant 1 | .0001 |
| Antifoggant 3 | .001 |
| Layer 2: Slow Cyan Layer | |
| iodobromide tabular emulsion 1 (0.94 micron by 0.115 micron, 4.1% iodide, dyed with a 6:1 ratio of CSD-1 and II-3 | .431 |
| iodobromide tabular emulsion 2 (0.61 micron by 0.115 micron, 1.5% iodide, dyed as above) | .492 |
| Gelatin | 1.776 |
| Cyan coupler 1 | .549 |
| Cyan coupler 2 | .038 |
| Cyan coupler 4 | .027 |
| Antifoggant 2 | .015 |
| Layer 3: Mid Cyan Layer | |
| iodobromide tabular emulsion 3 (1.40 micron by 0.12 micron, 4.1% iodide, dyed with a 6:1 ratio of CSD-1 and II-3) | .969 |
| Gelatin | 1.787 |
| Cyan coupler 1 | .237 |
| Cyan coupler 3 | .010 |
| Cyan coupler 4 | .022 |
| Antifoggant 2 | .015 |
| Layer 4: Fast Cyan Layer | |
| iodobroniide tabular emulsion 4 (2.5 micron by 0.13 micron, 4.1% iodide, dyed with a 6:1 ratio of CSD-1 and II-3) | 1.076 |
| Gelatin | 1.468 |
| Cyan coupler 1 | .095 |
| Cyan coupler 3 | .019 |
| Cyan coupler 4 | .032 |
| Cyan coupler 6 | .048 |
| Antifoggant 2 | .009 |
| Gold sulfide | .0005 |
| Layer 5: Interlayer | |
| Gelatin | 1.292 |
| Antifoggant 4 | .0001 |
| Layer 6: Slow Magenta Layer | |
| iodobromide tabular emulsion 5 (1.1 micron by 0.11 micron, 4.1% iodide, dyed with a 4:1 ratio of MSD-1 and MSD-2) | .269 |
| iodobromide tabular emulsion 6 (0.54 micron by 0.08 micron, 1.3% iodide, dyed as above) | .571 |
| Gelatin | 1.722 |
| Magenta coupler 1 | .269 |
| Magenta coupler 2 | .065 |
| Antifoggant 1 | .0001 |
| Antifoggant 2 | .015 |
| Antioxidant 2 | .021 |
| Layer 7: Mid Magenta Layer | |

-continued

| | |
|---|---|
| iodobromide tabular emulsion 7 (1.2 micron by 0.121 micron, 4.1% iodide, dyed as above) | .968 |
| Gelatin | 1.399 |
| Magenta coupler 1 | .065 |
| Magenta coupler 2 | .065 |
| Cyan coupler 5 | .024 |
| Antifoggant 2 | .015 |
| Antioxidant 2 | .016 |
| Gold sulfide | .0005 |
| Layer 8: Fast Magenta Layer | |
| iodobromide tabular emulsion 8 (2.2 micron by 0.128 micron, 4.1% iodide, dyed as above) | .968 |
| Gelatin | 1.012 |
| Magenta coupler 1 | .057 |
| Magenta coupler 2 | .054 |

-continued

| | |
|---|---|
| iodobromide octahedral emulsion 13 (1.03 micron, 9.0% iodide) | .614 |
| Gelatin | 1.184 |
| Yellow coupler 1 | .200 |
| Yellow coupler 2 | .080 |
| Yellow coupler 3 | .029 |
| Cyan coupler 1 | .029 |
| Cyan coupler 2 | .005 |
| Yellow dye 2 | .032 |
| Antifoggant 2 | .015 |
| Gold suifide | .0005 |
| Layer 12: UV Layer | |
| Silver bromide Lippman emulsion | .215 |
| Gelatin | .700 |
| UV dye 1 | .108 |
| UV dye 2 | .108 |

Yellow dye 1.

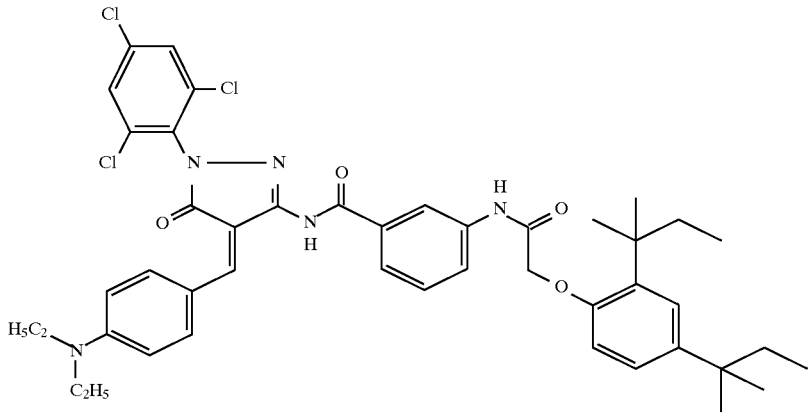

-continued

| | |
|---|---|
| Magenta coupler 3 | .011 |
| Yellow coupler 4 | .011 |
| Antifoggant 2 | .011 |
| Gold Sulfide | .001 |
| Layer 9: Yellow Filter Layer | |
| Gelatin | 1.292 |
| Yellow dye 3 | .108 |
| Antifoggant 4 | .0001 |
| Layer 10: Slow Yellow Layer | |
| iodobromide emulsion 9 (0.96 micron by 0.26 micron, 6.0% iodide, dyed with YSD-1) | .361 |
| iodobromide tabular emulsion 10 (0.81 micron by 0.09 micron, 4.1% iodide, dyed as above) | .211 |
| iodobromide tabular emulsion 11 (0.54 micron by 0.08 micron, 1.3% iodide, dyed as above) | .252 |
| Gelatin | 2.516 |
| Yellow coupler 1 | .700 |
| Yellow coupler 2 | .280 |
| Yellow coupler 3 | .065 |
| Cyan coupler 1 | .027 |
| Cyan coupler 2 | .003 |
| Antifoggant 2 | .015 |
| Antifoggant 5 | .0001 |
| Antioxidant 2 | .004 |
| Gold sulfide | .004 |
| Layer 11: Fast Yellow Layer | |
| iodobromide tabular emulsion 12 (2.3 micron by 0.13 micron, 4.0% iodide, YSD-1) | .215 |

Yellow dye 2. 1H-Pyrazole-3-carboxylic acid, 4,5-dihydro-5-oxo-1-(4-sulfophenyl)-4-((4-sulfophenyl)azo)-, trisodium salt.

Yellow dye 3. 1-Butanesulfonamide, N-(4-(4-cyano-2-(furanylmethylene)-2,5-dihydro-5-oxo-3-furanyl)phenyl)-.

Yellow dye 4. Benzamide, 3-(((2,4-bis(1,1-dimethylpropyl)phenoxy)acetyl)amino)-N-(4,5-dihydro-4-((methoxyphenyl)azo)-5-oxo-1 -(2,4,6-trichlorophenyl)-1H-pyrazol-3-yl)-.

UV dye 1. Propanedinitrile, (3-(dihexylamino)-2-propenylidene

UV dye 2. 2-Propenoic acid, 2-cyano-3-(4-methoxyphenyl)-, propyl ester.

Antifoggant 1. Acetamide, N,N'-(dithiodi-4,1-phenylene) bis.

Antifoggant 2. (1 ,2,4)Triazolo[1,5-a]pyrimidin-7-ol, 5-methyl-, sodium salt.

Antifoggant 3. 4-Thiazoleacetic acid, 2,3-dihydro-2-thioxo-.

Antifoggant 4. Palladium(II).(glycine)$_2$.

Antifoggant 5. Decamethylene, bisbenzothiazolium-1,3-bromide

Antioxidant 1. 1,4-Benzenediol, 2,5-bis(1,1,3,3-tetramethylbutyl)-.

Antioxidant 2. Benzenesulfonic acid, 2,5-dihydroxy-4-(1-methylheptadecyl)-, monopotassium salt.

Polymer 1. A 20:80 copolymer of 2-acrylamido-2-methylpropanesulfonic acid, sodium salt, and acrylamide.

MSD-1. Benzoxazolium, 5-chloro-2-(2-((5-phenyl-3-(3-sulfopropyl)-2(3H)-benzoxazolylidene)methyl)-1-butenyl)-3-(3-sulfopropyl)-, inner salt, triethylamine salt.

MSD-2. 1H-Benzimidazolium, 5-chloro-2-(3-(5-chloro-3-ethyl-1,3-dihydro-1-(3-sulfopropyl)-6-(tritluoromethyl)-2H-benzimidazol-2-ylidene)-1-propenyl)-3-ethyl-1-(3-sulfopropyl)-6-(trifluoromethyl-, inner salt, sodium salt.

YSD-1. Benzothiazolium, 5-chloro-2-((5-chloro-3-(3-sulfopropyl)-2(3H)-benzothiazolylidene)methyl)-3-(3-sulfopropyl)-, inner salt, triethylamine salt.

Sample 1-2 (Comparison) was prepared like sample 1-1 except that the emulsions and dyes used in layers 2–4 were changed as follows:

iodobromide tabular emulsion1 was 1.0 micron by 0.09 micron, 4.1% iodide dyed with a 9:1 ratio of II-3 to CSD-2.

iodobromide tabular emulsion2 was 0.54 micron by 0.08 micron, 1.3% iodide, dyed as above.

iodobromide tabular emulsion3 was 1.4 by 0.12 micron, 4.1% iodide, dyed as above.

iodobromide tabular emulsion4 was 2.8 micron by 0.13 micron, 4.1 % iodide, dyed as above.

Sample 1-3 (Invention) was prepared like sample 1-1 except that the emulsions and dyes used in layers 2–4 were changed as follows:

iodobromide tabular emulsion1 was 1.0 micron by 0.114 micron, 4.1% iodide dyed with a 2:1 ratio of I-1 to II-3, coated at 0.452 g/m$^2$.

iodobromide tabular emulsion2 was 0.53 micron by 0.12 micron, 1.3% iodide, dyed as above, coated at 0.215 g/m$^2$.

iodobromide tabular emulsion3 was 1.44 by 0.12 micron, 4.1% iodide, dyed as above.

iodobromide tabular emulsion4 was 3.1 micron by 0.14 micron, 4.1% iodide, dyed as above.

iodobromide tabular emulsion2a was added to layer 2, 0.587 micron by 0.069 micron, 1.3% iodide, dyed as above, coated at 0.495 g/m$^2$ Some components of the coating were incorporated as dispersions.

The composition of the these dispersions is given as follows:.

| Component | wt % | % gel | solvent1 | wt % | solvent2 | wt % | pH | surfactant % |
|---|---|---|---|---|---|---|---|---|
| cyan coupler 1 | 6 | 8 | sol-2 | 6 | sol-10 | 12 | 5.10 | |
| cyan coupler 2 | 3 | 10 | sol-3 | 3 | sol-11 | 9 | 4.70 | |
| cyan coupler 3 | 2 | 10 | sol-2 | 8 | | | 5.10 | 0.7 |
| cyan coupler 4 | 13 | | sol-4 | 2 | | | 5.20 | |
| cyan coupler 5 | 2 | 10 | sol-5 | 4 | | | 5.05 | 0.42 |
| cyan coupler 6 | 1.1 | 10 | sol-1 | 4.4 | | | 5.10 | 0.56 |
| magenta coupler 1 | 5 | 8 | sol-1 | 4.5 | sol-10 | 15 | 5.00 | |
| magenta coupler 2 | 4 | 8 | sol-1 | 8 | sol-10 | 8 | 5.10 | |
| magenta coupler 3 | 2.2 | 12.5 | sol-1 | 4.4 | sol-11<br>sol-12 | 3.3<br>3.3 | 5.05 | 0.56 |
| yellow coupler 1 | 9 | 8 | sol-2 | 9 | | | 5.10 | 0.8 |
| yellow coupler 2 | 9 | 6.5 | sol-2 | 4.5 | sol-10 | 15 | 5.15 | |
| yellow coupler 3 | 7 | 10 | sol-2 | 7 | | | 5.10 | 0.6 |
| yellow coupler 4 | 6 | 10 | sol-2 | 6 | sol-11 | 3 | 4.75 | 0.84 |
| cyan dye 1 | 2.5 | 6 | sol-2 | 12.5 | | | 5.00 | |
| magenta dye 1 | 4 | 10 | sol-1 | 16 | | | 5.10 | 0.6 |
| yellow dye 1 | 4 | 8 | sol-1 | 8 | | | | |
| yellow dye 3 | 25 | 20 | | | | | 5.20 | |
| yellow dye 4 | 8.7 | 6 | | | sol-11 | 26 | 5.65 | 0.3 |
| UV dye 1 | 3.75 | 10 | sol-1 | 5.25 | | | 5.00 | 0.6 |
| UV dye2 | 3.75 | | | | | | | |

sol-1 = tricresyl phosphate,
sol-2 = dibutyl phthalate,
sol-3 = diethyllauramide,
sol-4 = 2-phenoxyethanol,
sol-5 = N-butylacetanilide,
sol-10 = ethyl acetate,
sol-11 = 2-(2-butoxyethoxy)ethyl acetate,
sol-12 = triethyl phosphate,
sol-13 = cyclohexanone,
surfactant = triisopropylnaphthalenesulfonic acid, sodium salt.

In these formulas, solvent 2 is an auxiliary solvent and is generally removed by washing or evaporation after tbe dispersion is formed.

Sample 1-1 had a red spectral sensitivity maximum at 650 nm, sample 1-2 at 660 nm, and sample 1-3 at 630 nm. Thus, sample 1-3 has improved color reproduction and improved illuminant insensitivity relative to samples 1-1 and 1-2 because it is closer to the eye sensitivity at 610 nm.

Film strips of these samples were given a $D_{max}$ exposure, then submitted to a standard Kodak Flexicolor C-41 color development as described hereafter except that the bleach step was omitted. The amount of developed silver was measured by measuring the IR density of the film by total transmission. The strips were then desilvered in a KF-12 (Bleach I) solution (containing per liter $FeNH_4EDTA$ (98.56g), $NH_4Br$ (150g), acetic acid (10ml), total Fe=15.2, pH=6) for 2, 3, 4, 5, or 7 minutes. After each desilvering time the strips were treated with a silver fixing agent and washed. The amount of unbleached, unfixed silver remaining in the film was again measured by IR density. The results are shown in Table 1. The table shows that sample 1-3 with dyes II-3 and I-1 had less retained silver at all bleaching times. This sample also had better color reproduction and required no additional bleach accelerator releasing coupler to achieve the superior desilvering.

The comparative sensitizing dyes used in the multilayer experiments were as follows:

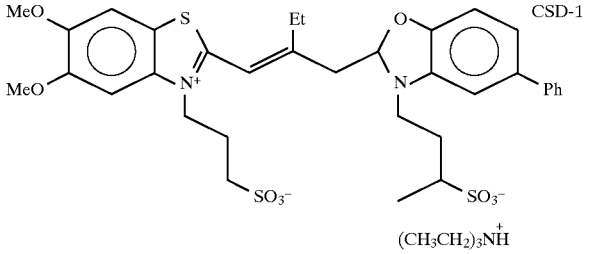

-continued

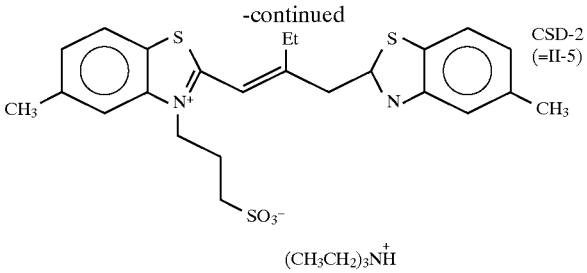

TABLE 1

| Time in Bleach Solution | % IR density remaining Sample 1-1 Comparison | Sample 1-2 Comparison | Sample 1-3 Invention |
|---|---|---|---|
| 2' | 19.1% | 18.5% | 15.3% |
| 3' | 15.3% | 13.4% | 10.8% |
| 4' | 12.1% | 10.2% | 7.9% |
| 5' | 10.7% | 8.3% | 6.9% |
| 7' | 8.4% | 6.0% | 4.4% |

Example 1b

The processing of Samples 1-1 to 1-3 was repeated, except that the bleach solution was deliberately contaminated with 10% by volume of developer solution. This is to simulate seasoning of the developer as might occur during actual trade processing.

The percentage of retained silver (by IR density) vs. bleaching time is shown in Table 2. Again the sample with dyes II-3 and I-1 on the red sensitive emulsions (sample (1-3) had less retained silver at all bleaching times.

TABLE 2

| Time in Bleach Solution | % IR density remaining Sample 1-1 Comparison | Sample 1-2 Comparison | Sample 1-3 Invention |
|---|---|---|---|
| 2' | 24.7% | 24.5% | 21.7% |
| 3' | 18.1% | 18.5% | 15.8% |
| 4' | 15.3% | 14.8% | 11.8% |
| 5' | 11.6% | 12.0% | 9.4% |
| 7' | 8.8% | 8.3% | 5.9% |

Example 2

A second color negative multilayer film was prepared that was similar to the film in Example 1. Again sample 2-1 (Comp) used a 9:1 molar ratio of dyes II-3 and CSD-2 on the emulsions of the red sensitive layer. Sample 2-2 (Inv) used a 1:2 molar ratio of the dyes II-3 and I-1. In addition, sample 2-3 (Inv) was prepared which used a 1:2 molar ratio of the dyes II-3 and I-8. The same bleaching tests were performed as in Example I b using the bleach that was diluted with 10% developer.

The results are given in Table 3. In this case, both samples 2-2 and 2-3 have red sensitivity at 630 nm (improved color reproduction) while also demonstrating improved desilvering.

TABLE 3

| Time in Bleach Solution | % IR density remaining Sample 2-1 Comparison | Sample 2-2 Comparison | Sample 2-3 Invention |
|---|---|---|---|
| 2' | 22.5% | 18% | 17% |
| 3' | 16.5% | 12.5% | 12% |
| 4' | 12.5% | 9% | 8.5% |
| 5' | 9.5% | 7% | 6.5% |
| 6' | 8.5% | 6% | 5.5% |
| 7' | 6.5% | 4% | 4% |

Example 3

A third multilayer film was prepared as in Examples 1 and 2. In this case, sample 3-1 (Inv) used a 1:2 molar ratio of dyes II-3 and I-1 as the sensitizing dyes for the emulsions in layers 2, 3, and 4. Sample 3-2 (Inv) used a 1:9 molar ratio of dyes II-3 and I-1 in layers 2, 3, and 4. The red spectral sensitivity maximum of sample 3-1 was 630 nm. The red spectral sensitivity maximum of sample 3-2 was 615 nm. The same bleaching test was performed on this film as for Examples 1 and 2. The results are given in Table 4.

TABLE 4

| Time in Bleach Solution | % IR density remaining Sample 3-1 Invention | Sample 3-2 Invention |
|---|---|---|
| 2' | 18.7% | 17.1% |
| 3' | 14.6% | 10.4% |
| 4' | 11.0% | 7.1% |

This example shows that the ratio of the red sensitizing dyes can be changed to give an even shorter wavelength red sensitization, and achieving even more improvement in the silver bleaching performance in a seasoned bleach solution.

What is claimed is:

1. A color negative photographic element comprising a transparent support bearing at least two light sensitive silver halide emulsion layers sensitive to blue light, at least two such layers sensitive to green light, and at least two such layers sensitive to red light, wherein at least one of the red sensitive emulsion layers is spectrally sensitized with both of the following dyes:

(A) a sensitizing dye of the formula (I):

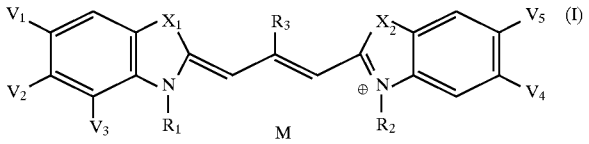

wherein:

either $V_1$ and $V_2$ or $V_2$ and $V_3$ are joined to form a fused ring and the remaining member of $V_1$, $V_2$, and $V_3$ is hydrogen;

$V_4$ and $V_5$ are independently selected from the group consisting of hydrogen, methyl, ethyl, methoxy, ethoxy, halogen, phenyl groups, heteroaromatic 5- or 6-membered ring groups, cyano, and acetamido;

$R_1$ and $R_2$ are independently 2 to 6 carbon alkyl groups at least one of which is substituted by a carboxyl or sulfonic acid anion;

$R_3$ is an alkyl group of 1 to 4 carbon atoms;

$X_1$ and $X_2$ are either oxygen or sulfur but are not the same; and

M is a counter ion to balance the charge on (I);

and (B) a sensitizing dye of the formula (II):

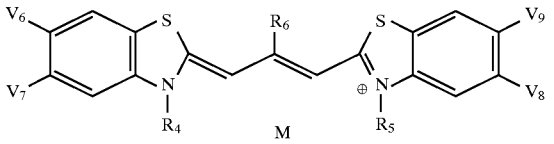

(II)

wherein $V_6$, $V_7$, $V_8$ and $V_9$ are independently any of the groups as described for $V_4$ in formula (I);

$R_4$ and $R_5$ are independently any of the groups described for $R_1$ in formula (I);

$R_6$ may be any of the groups as described for $R_3$ in formula (I); and

M is a counter ion to balance the charge of (II).

2. The element of claim 1 wherein the molar ratio of the dye of formula (I) to the dye of formula (II) in the emulsion layer is from 0.1 to 10:1.

3. The element of claim 2 wherein the ratio is from 2 to 9:1.

4. The element of claim 1 wherein the wavelength of maximum sensitivity imparted by the dye combination is less than 640 nm.

5. The element of claim 4 wherein the wavelength of maximum sensitivity is at least 600 nm.

6. The element of claim 4 wherein the wavelength of maximum sensitivity imparted by the dye combination is between 610 and 635 nm.

7. The element of claim 4 wherein the sensitivity at 650 nm is not more than 35% of the maximum sensitivity.

8. The element of claim 7 wherein the sensitivity at 650 nm is not more that 25% of the maximum sensitivity.

9. The element of claim 1 wherein both $R_1$ and $R_2$ are carboxyl or sulfonic acid anion substituted and M is a cation.

10. The element of claim 1 wherein the fused benzene ring is formed by $V_2$ and $V_3$.

11. The element of claim 1 wherein at least one of $V_4$ and $V_5$ are methyl or methoxy.

12. The element of claim 1 wherein $X_1$ is sulfur and $X_2$ is oxygen.

13. The element of claim 12 wherein the fused benzene ring is formed by $V_2$ and $V_3$.

14. The element of claim 12 wherein at least one of $V_4$ and $V_5$ are methyl or methoxy.

15. The element of claim 1 wherein $R_1$, $R_2$, $R_4$, and $R_5$ are independently selected alkyl groups of from 2 to 6 carbon atoms each substituted with a sulfonic acid anion, and M is a cation to balance the charge.

16. The element of claim 15 wherein $V_6$, $V_7$, $V_8$ and $V_9$ are independently selected from the group consisting of hydrogen, halogen, methyl, and methoxy.

17. The element of claim 1 wherein dye (I) has formula (IA) and dye (II) has formula (IIA):

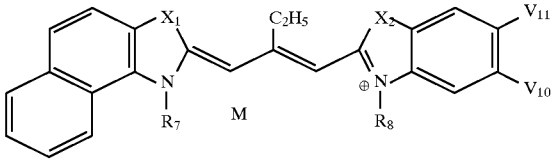

(IA)

-continued

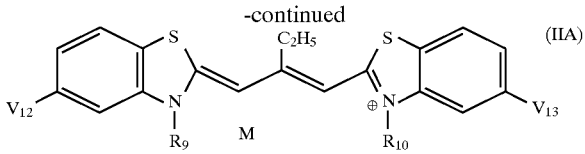

(IIA)

wherein $V_{10}$, $V_{11}$, $V_{12}$, and $V_{13}$ are selected from the group consisting of methyl, methoxy, hydrogen, and halogen and $R_7$, $R_8$, $R_9$, and $R_{10}$ are sulfoalkyl groups containing 2–6 carbon atoms.

18. The element of claim 1 wherein the dye of formula (I) is selected from the group consisting of:

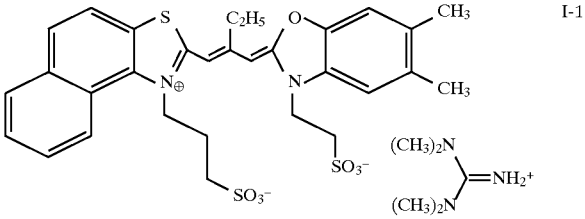

I-1

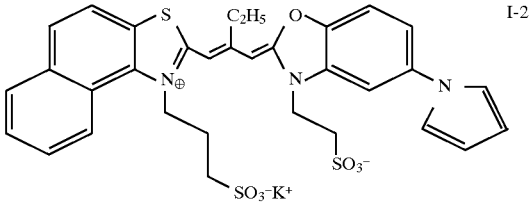

I-2

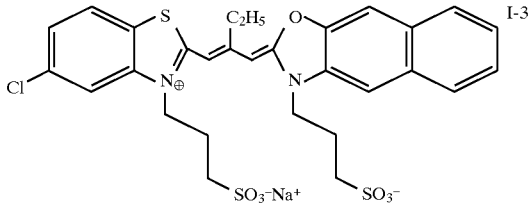

I-3

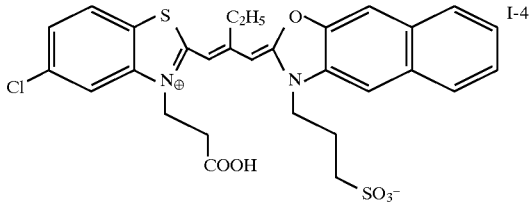

I-4

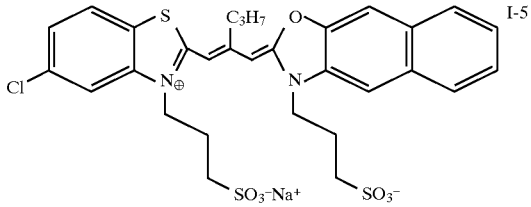

I-5

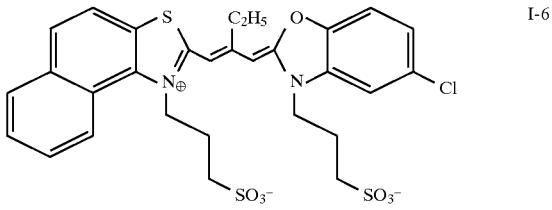

I-6

$(CH_3CH_2)_3NH^+$

-continued
I-7
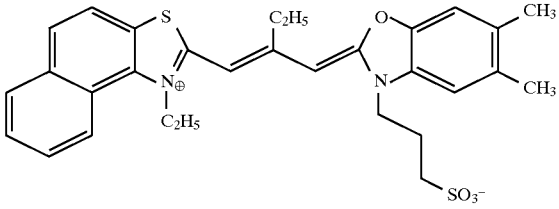
I-8
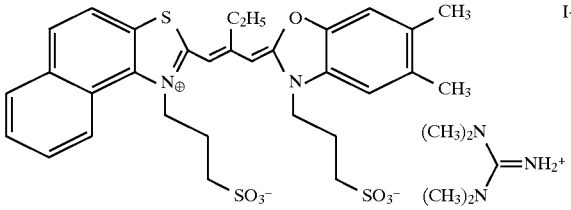
I-9
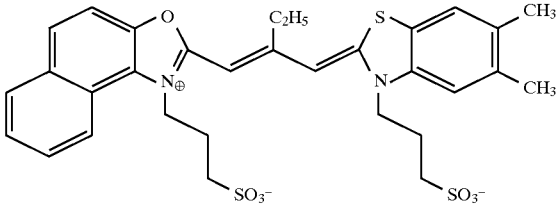
$(CH_3CH_2)_3NH^+$
I-10
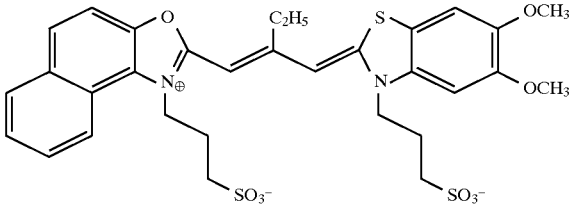
$(CH_3CH_2)_3NH^+$
I-11
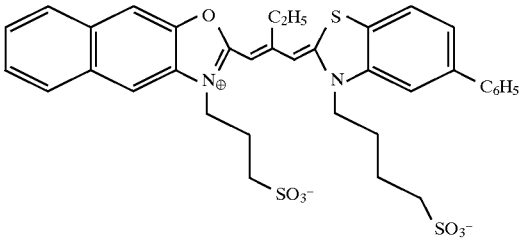
$(CH_3CH_2)_3NH^+$
and
I-12
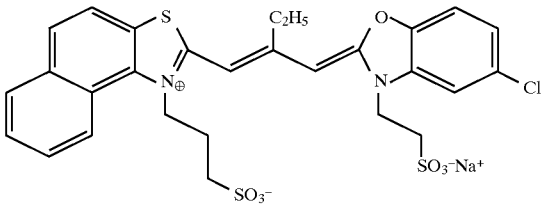
$(CH_3CH_2)_3NH^+$
II-1
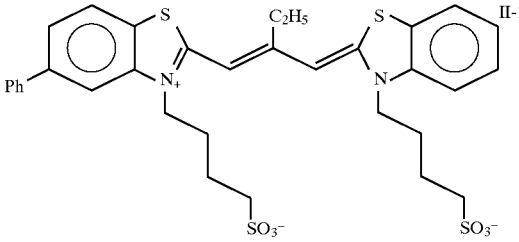
$(CH_3CH_2)_3NH^+$
II-2
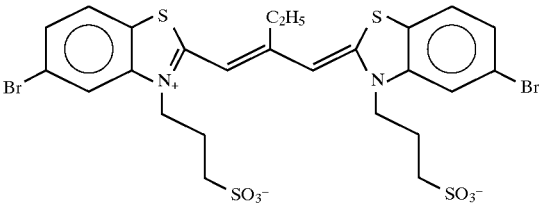
$(CH_3CH_2)_3NH^+$
II-3
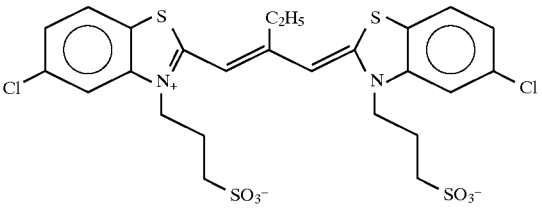
$(CH_3CH_2)_3NH^+$
II-4
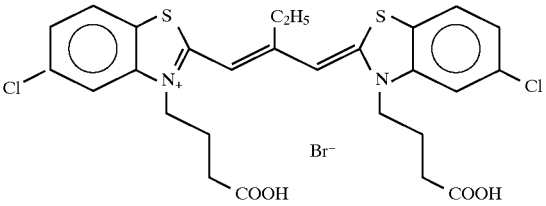
II-5
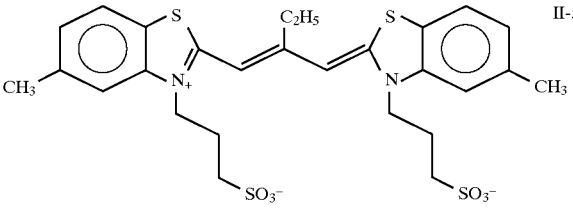
$(CH_3CH_2)_3NH^+$
II-6
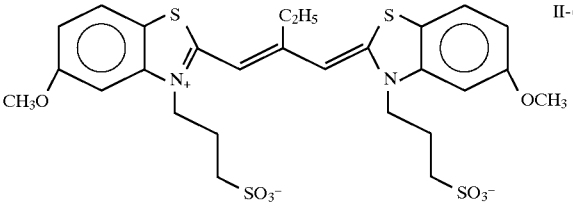
$(CH_3CH_2)_3NH^+$
19. The element of claim 1 wherein the dye of formula (II) is selected from the group consisting of:

-continued
II-7
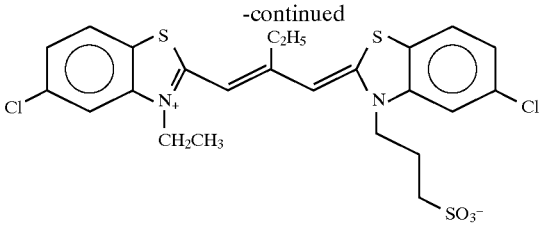
II-8
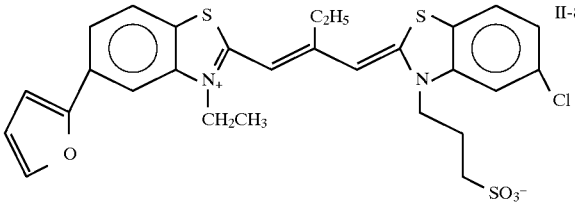
II-9
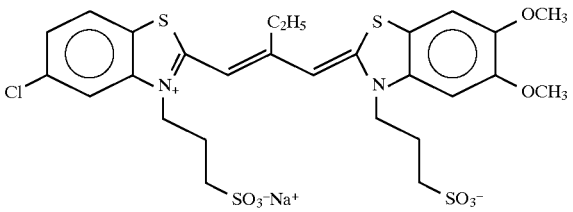
and
II-10
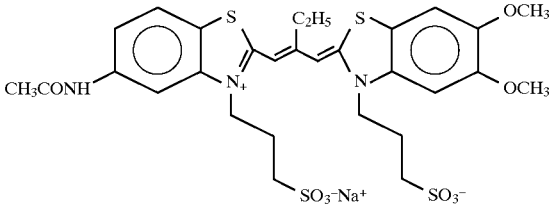
20. The element of claim 19 wherein the dye of formula (I) is selected from the group consisting of:
I-1
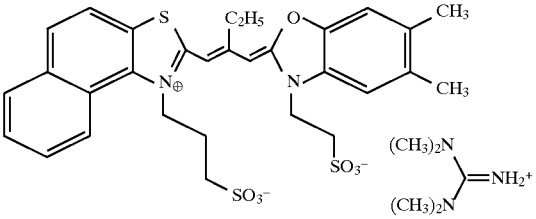
I-2
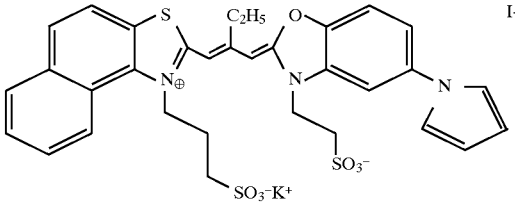
I-3
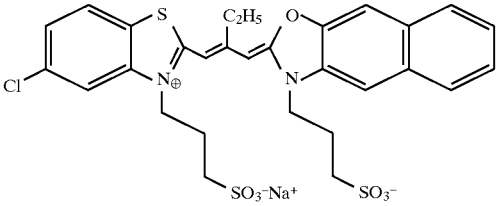
-continued
I-4
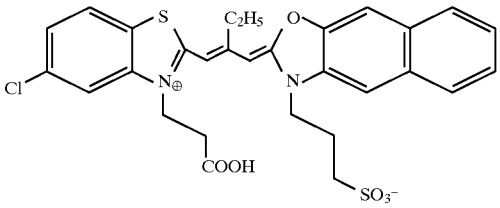
I-5
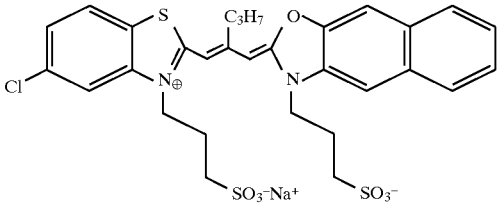
I-6
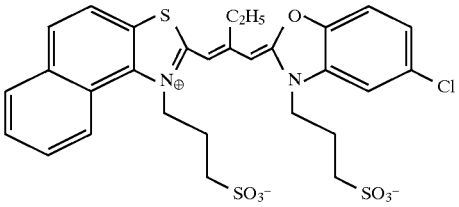
$(CH_3CH_2)_3NH^+$
I-7
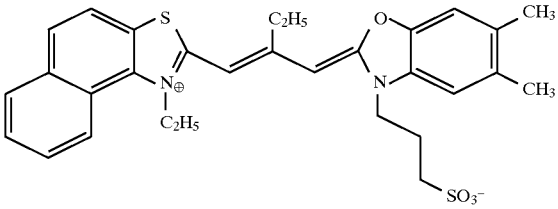
I-8
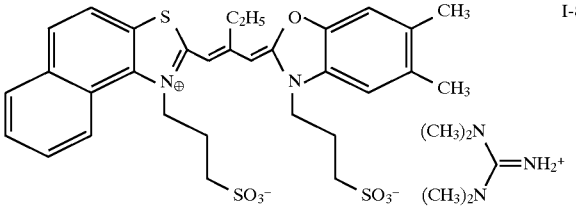
I-9
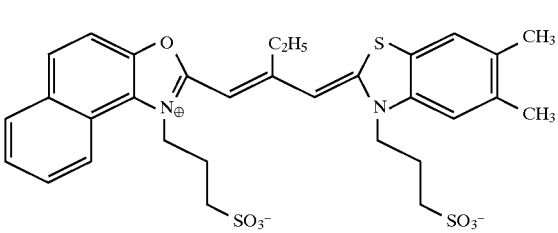
$(CH_3CH_2)_3NH^+$ -continued

I-10

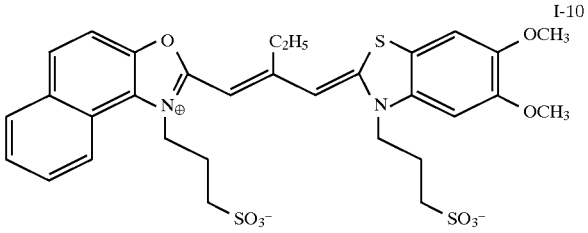

$(CH_3CH_2)_3NH^+$

I-11

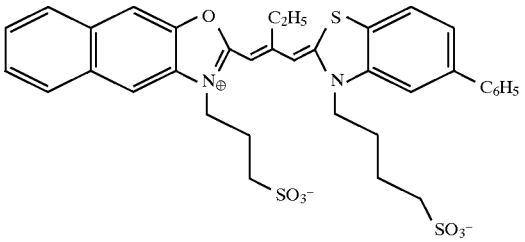

$(CH_3CH_2)_3NH^+$ and

I-12

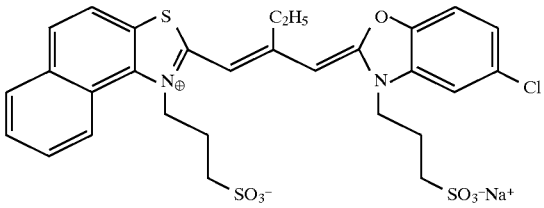

$(CH_3CH_2)_3NH^+$

21. The element of claim 1 wherein the at least one red sensitive emulsion layer is an iodobromide emulsion containing 10 mole % or less silver iodide.

22. The element of claim 21 wherein the layer contains from 2 to 6 mole % silver iodide.

23. The element of claim 21 wherein the at least one red sensitive emulsion layer is an iodobromide emulsion containing a tabular emulsion having an aspect ratio of at least 3.

24. The element of claim 1 wherein the at least one red sensitive emulsion layer additionally contains a dispersed coupler which is a phenolic or naphtholic coupler.

25. The element of claim 24 wherein the coupler is a 2,5-dicarbonamidophenol, a 2-ureido-5-carbonamidophenol, or a 2-carbonamido-5-alkylphenol.

26. A process for forming a color image after exposure of the element of claim 1 to light comprising contacting the element with a color developing agent and thereafter bleaching the element to remove silver.

27. The process of claim 26 wherein the image is a negative image.

28. The process of claim 26 wherein the element is subjected to reversal processing prior to contact with the color developing agent, and the resulting image is a positive image.

* * * * *